United States Patent [19]

Ferguson

[11] Patent Number: 4,782,639

[45] Date of Patent: Nov. 8, 1988

[54] SHINGLE OR SHAKE PANEL AND PROCESS FOR USING THE SAME

[76] Inventor: Stewart Ferguson, P.O. Box 376, Pacific Beach, Wash. 98571

[21] Appl. No.: 840,261

[22] Filed: Mar. 13, 1986

[51] Int. Cl.[4] ..... E04D 1/34

[52] U.S. Cl. ..... 52/551; 52/553; 52/547

[58] Field of Search ..... 52/535, 545, 547, 550, 52/551, 553, 560, 459, 460, 462, 478, 551, 540, 555, 519, 559

[56] References Cited

U.S. PATENT DOCUMENTS

| | | | |
|---|---|---|---|
| 2,711,702 | 6/1955 | Robinson | 57/554 X |
| 3,121,481 | 2/1964 | Johnson | 52/311 X |
| 3,640,044 | 2/1972 | Watts | 52/535 X |
| 3,664,081 | 5/1972 | Martin et al. | 52/551 |
| 4,015,391 | 4/1977 | Epstein et al. | 52/547 X |
| 4,050,209 | 9/1977 | Barker et al. | 52/535 X |
| 4,089,141 | 5/1978 | Heroux | 52/547 X |
| 4,102,107 | 7/1978 | Barker et al. | 52/553 |
| 4,295,314 | 10/1981 | Ferguson | 52/553 |
| 4,499,701 | 2/1985 | Bockwinkel et al. | 52/553 X |
| 4,548,011 | 10/1985 | Martin | 52/551 |
| 4,586,309 | 5/1986 | Ferguson | 52/553 X |

*Primary Examiner*—David A. Scherbel
*Assistant Examiner*—Creighton Smith
*Attorney, Agent, or Firm*—Robert W. Beach; Ward Brown

[57] ABSTRACT

A shingle or shake panel is composed of shingles progressively increasing in width from one end of the panel, the narrowest shingle or shake being at least substantially three times the offset between adjacent shingle panels in adjacent courses. Apparatus for making such shingle or shake panels trims the individual shingles or shakes to width, accumulates them in a storage bin or wheel and dispenses the shingle or shakes from such storage bin or wheel to a fabricating table where the shingles or shakes are integrated by a strip secured to their outer face at a location such that the edge of the strip farther from the butts of the shingles or shakes is spaced from the butts of the shingles or shakes a distance equal to the weather exposure of the butt portions of the shingles or shakes.

9 Claims, 9 Drawing Sheets

SHINGLE OR SHAKE PANEL AND PROCESS FOR USING THE SAME

BACKGROUND OF THE INVENTION

1. Field of the Invention

This invention relates to a shingle panel or a shake panel and to apparatus for making such panels.

2. Problem

Applying shingles or shakes to a roof or to a sidewall individually is a tedious process and requires considerable skill, dexterity and judgment to select shingles or shakes of appropriate width from a selection of random width shingles or shakes in order to break the joints appropriately between the shingles or shakes in successive courses. In order to insure a weathertight roof, the standards of the industry require that the joints in any three successive courses be offset. The width of such offset can vary but usually is at least 1 ½ inches (3.81 cm).

Also, the space between the shingles or shakes at each joint must range between a minimum of ⅛ inch (0.32 cm), to allow for expansion and contraction of the shingles or shakes under different temperature and humidity conditions, and a maximum of ⅜ inch (0.96 cm), or at most ½ inch (1.27 cm).

In order to provide better control over the factors of spacing between adjacent shingles or shakes at the joints and to expedite application of the shingles or shakes, various proposals have been made for initially prefabricating shingle or shake panels at a factory, which panels are then applied to a roof or sidewall in the field. Difficulties with such panels are in general: they are more expensive than individual shingles or shakes; they are inclined to be heavy; and the problem arises of providing a satisfactory weathertight joint between adjacent ends of adjacent panels.

3. Prior Art

Shingle panels previously proposed are principally of two different types. first, those that have a full panel backing and, second, those that have a partial panel backing. The backing of panels having a full panel backing is usually made of plywood and the panels may have one, two or three courses of shingles.

Panels having a partial panel backing may use plywood or board strips. An example of such a panel is shown in Barker et al. U.S. Pat. No. 4,102,107, issued July 25, 1978. In that instance, the backing strips are made of plywood.

If the panels have a full panel backing, it is only necessary to provide upper and lower joints and end joints which will be weathertight. Where a panel has only a partial backing, it is also necessary to be concerned that the joints between shingles or shakes in each course are out of registration with the joints between shingles or shakes at least in the course above and in the course below, and preferably out of registration with the joints in two courses above and two courses below each particular course. In order to assure such break joint arrangement, it has been considered to be essential for the pattern in which the shingles or shakes are arranged to be identical in each panel. Also, such panels would necessarily all be of equal length, usually approximately 4 feet (1.2 meters), but such panels could be 2 feet (0.6 meter) in length.

The panel disclosed in U.S. Pat. No. 4,102,107 is composed of two sets of repetitive shingle widths to make a panel approximately 4 feet (1.2 meters) in length. A principal difficulty with this panel, however, as shown in FIGS. 8 and 12, for example, is that joints between the shingles in one course are in registration with the joints between the shingles in the second course below and in the second course above a selected course instead of such joints being broken for two courses above and two courses below any selected course.

While the shingle panels shown in U.S. Pat. No. 4,102,107 utilize shingles of four different widths, it is not clear from the disclosure of that patent how more different widths could be used practically.

SUMMARY OF THE INVENTION

It is an object of the present invention to provide a shingle or shake panel which can be laid quickly on a roof or applied to a sidewall by a person who is not a skilled shingler and will provide a weathertight structure.

A further object is to provide such a panel which can be composed of shingles of a large number of different widths to minimize waste of wood in trimming shingles to required widths.

Another object is to provide shingle panels of economical structure by requiring a minimum of backing.

It is also an object to provide shingle or shake panels which can be applied to simulate a roof or sidewall constructed of individual random width shingles or shakes.

Another object is to facilitate application of the shingle or shake panels not only by having the panels prefabricated but also by making provision so that the amount of exposure of the shingles or shakes in each panel to the weather is readily established.

An additional important object is to provide equipment by which panels of the present invention can be made quickly and easily.

The foregoing objects can be accomplished by utilizing in a shingle or shake panel shingles or shakes, of progressively increasing width from one end of the panel to the other, the width of the narrowest shingle or shake in the panel being equal to or exceeding three times the minimum increment of lengthwise offset of panels in adjacent courses. The equipment for making such panels provides for assembly of an assortment of shingles or shakes from which to make a panel, simultaneously trimming to the appropriate width and edging such shingles or shakes, feeding the trimmed and edged shingles or shakes to a fabricating table and fabricating such assembly of shingles or shakes into a panel by connecting them with an integrating strip.

DETAILED DESCRIPTION

Figure 1:
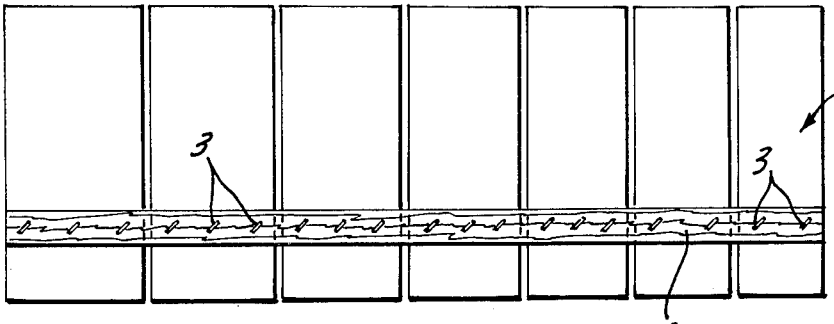
FIG. 1 is a plan.
Figure 2:
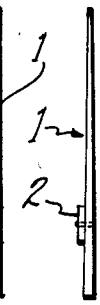
FIG. 2 is an end view of a shingle panel according to the present invention.
Figure 5:
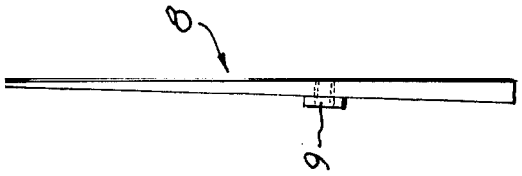
FIG. 5 is an end view of a shake panel according to the present invention similar to the shingle panel shown in FIGS. 1 and 2.
Figure 4:
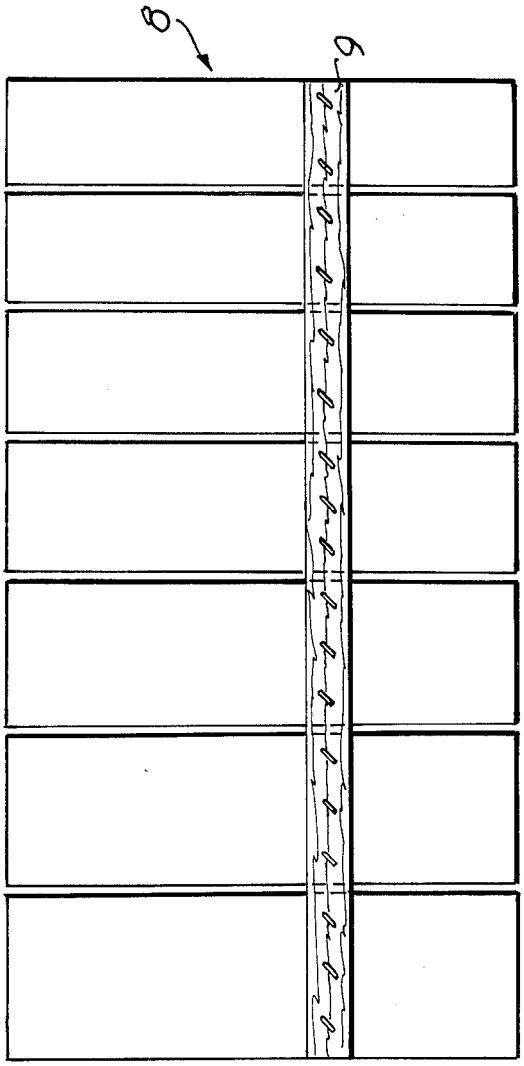
FIG. 4 is a plan.

FIGS. 1 and 2 show a preferred type of shingle panel article of commerce according to the present, invention, and FIGS. 4 and 5 show a preferred type of shake panel article of commerce according to the present invention. The width of the shingles shown in FIG. 1 and the width of the corresponding shakes shown in FIG. 4 are the same. The shingles shown in FIGS. 1 and 2 are 16 inches (40.64 cm) in length, which is a standard length, and the panel is designed for an exposure to the weather of 5 inches (12.70 cm) of the butt portions of such shingles, which is a standard exposure. The shakes shown in FIGS. 4 and 5 on the other hand are 24 inches (60.96 cm) in length and have an exposure width of 10 inches (25.40 cm) of the butt portions, which again is a standard exposure for shakes of such length. In the remainder of the description, therefore, as to the application of the panels and their fabrication, reference will be made to shingles with the understanding that the discussion applies to shakes as well as shingles.

The present invention is concerned with wood shakes and shingles as distinguished from asphalt shingles or slate shingles. The term wood shingles is applied to wood panels which are sawn and taper from butt to tip. Usually shingles are 16 inches (40.64 cm) in length, but in some instances are 8 inches (45.72 cm) in length, and even 24 inches (60.96 cm) in length. For shingles 16 inches (40.64 cm) in length, the standard width of exposure of the butt portions of the shingles in each course of a roof is 5 inches (12.70 cm), whereas the standard exposure would be greater, such as 5-½ inches (15.24 cm), for an 18-inch (45.72 cm) shingle, or 7-½ inches (19.15 cm) for a 24-inch (60.96 cm) shingle.

Shakes differ from shingles in that at least one face of each shake is split or artificially grooved whereas the faces of shingles are smooth sawn. Both faces of a shake may be split, or one side can be sawn and the other split or artificially grooved. Manufacture of shakes having one sawn face and one split face is accomplished by splitting shake boards of substantially uniform thickness and then resawing such boards lengthwise on a diagonal to provide a sawn back surface for each shake with a split front face. The shakes are tapered from butt to tip.

The type of shingle panel preferred for the present invention is shown in FIGS. 1 and 2 as including shingles 1 arranged in a only one row with their butts and tips correspondingly oriented and integrated by a strip 2 secured to the front face of the shingles by unclinched staples 3. The edge of the strip farther from the butt ends of the shingles is spaced from such butt ends a distance equal to the desired width of exposure of the shingle butt portions when the shingles are laid, such exposure width being indicated in FIG. 1 as being 5 inches (12.70 cm) for shingles 16 inches (40.64 cm) in length.

Shingles and shakes are of random width because the blocks from which they are cut are of different widths and it is desirable to cut blocks in different directions in order to obtain shingles of edge grain as far as possible. Consequently, shingles are of varying widths, usually from 3 inches (7.62 cm) to 12 inches (30.48 cm). Wood such as western red cedar or redwood from which shingles are customarily produced is becoming increasingly scarce and expensive. Consequently, it is important to minimize waste of wood in producing shingles. If the shingles were all of the same width, the waste of wood would be much greater than if the shingles were of different widths. While it is preferable not to utilize shingles of all widths, substantial economy can be achieved if shingles having a considerable variety of widths can be used. In the shingle panel of FIG. 1, seven widths of shingles are used from 5 inches (12.70 cm) in width to 8 inches (20.32 cm) differing in increments of ½ inch (1.27 cm) between the narrowest and widest shingles.

While for the purpose of the present invention the shingles can be arranged in any width pattern from one end of a panel to the other as long as all of the panels utilize the same width pattern, fabrication of the panels is facilitated if the successive shingles are of progressively greater width from one end of the panel to the other. In FIG. 1, the progressive increase in width is shown as being from right to left but, alternatively, the progressive increase in width could be from left to right as long as the pattern of arrangement of the shingles according to width is the same in all of the panels from one end of the panel to the other, as stated above.

The shingle-integrating strips 2 can be of any desired width and thickness, but, in order to be able to integrate the shingles reliably, they should be at least approximately ¼ inch (0.64 cm) in thickness and at least 1 inch (2.54 cm) in width, although they are preferably 2 inches (5.08 cm) in width. Conventional lath strips are suitable for such integrating strips. The edges of such strips nearer the butt ends of the shingles will be spaced from the shingle butt ends several inches since the strip edge farther from the shingle butt ends is spaced from such ends a distance equal to the exposure width of the butt end portions of the shingles.

It is preferred that the length of each shingle panel be approximately 4 feet (1.2 meters) utilizing seven widths of shingles, as illustrated in FIG. 1, from 5 inches (12.70 cm) in width to 8 inches (20.32 cm) in width varying in increments of ½ inch (1.27 cm). The composite width of such shingles would be 45 ½ inches (113.19 cm). Allowance must be made in the overall length of the shingle panel, however, for suitable spacing between adjacent edges of adjacent shingles. If the spacing in each instance is ⅜ inch (0.95 cm), the aggregate width of the six spaces would be 2 ¼ inches (5.71 cm) which, added to the aggregate width of the shingles of 45 ½ inches (113.19 cm), would make a total panel length of 47 ¾ inches (118.90 cm). The ends of adjacent panels could then be spaced apart ¼ inch (0.64 cm) to make a total effective panel length of 48 inches (119.54 cm).

Figure 3:
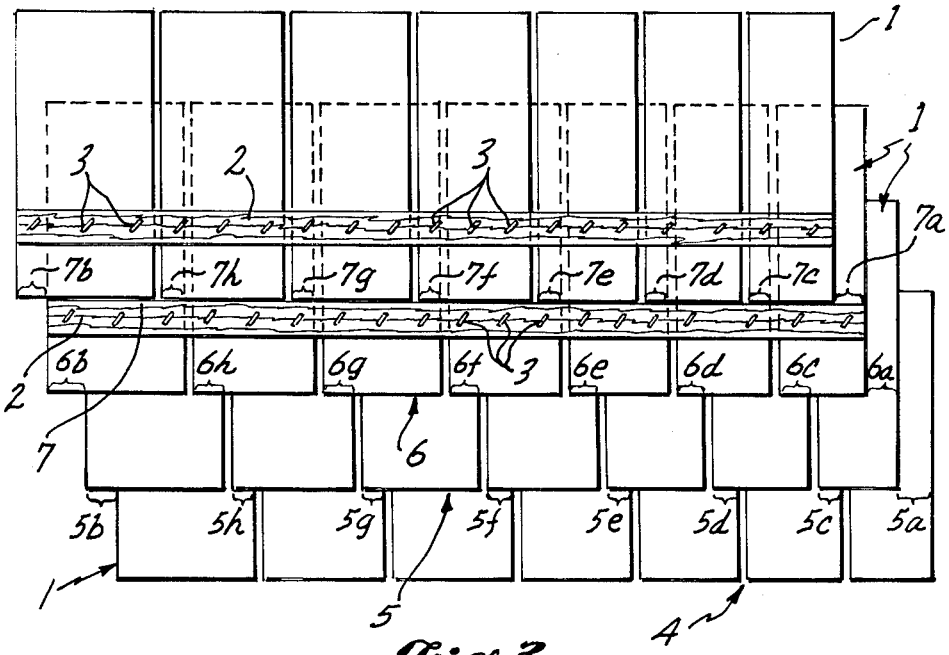
FIG. 3 is an elevation of a section of a roof or sidewall constructed from shingle panels according to the present invention.

The joints between shingles should be offset or staggered in adjacent courses at least 1 ½ inches (3.81 cm) and joints should not be substantially in alignment or registration in either of the two courses above or the two courses below any selected course. FIG. 3 shows a section of shingle panels according to the present invention laid either on a roof or a sidewall.

The lower course 4 shown in FIG. 3 may overlie a starter course at the eave according to conventional shingling practice or be any course in which the end of a shingle panel is applied with its end flush with a roof edge or rake. In the roof section shown in FIG. 3 it is contemplated that the panels will be laid on the roof from left to right with the left end of the panel in the first course 4 being flush with the left edge or rake of the roof. The next higher panel in course 5 will then be offset approximately 1 ½ inches (3.81 cm) in one direction or the other from the panel in course 4 to break the joints. In the illustration of FIG. 3 the panel in course 5 has been shifted to the left relative to the panel in course 4 so that the overhang of the end panel in course 5 beyond the roof edge can subsequently be cut off. Such arrangement will provide an offset 5*a* at the right end of the panels to enable the end portion of the next panel in course 5 to overlap the right shingle in the course 4 panel by at least approximately 1 ½ inches (3.81 cm). Because the panels in course 4 and in course 5 are of the same length, the overhang 5*b* at the left of course 5 will be equal to the offset 5*a* between the left end of the panel in course 5 and the adjacent end of the underlying panel in course 4. Because the pattern of the arrangement of shingle widths is the same in both panels, corresponding joints in the two panels will be offset by equal increments 5*c*, 5*d*, 5*e*, 5*f*, 5*g* and 5*h*, each of approximately 1 ½ inches (3.81 cm).

While normally the panels for the entire course 4 will be laid by nailing the shingles of that course to the wall or roof sheathing before beginning to lay panels in the next higher course 5, the roof section shown in FIG. 3 illustrates only one panel in each course for illustrative purposes. After laying of course 5 has been completed, the panels for the next higher course 6 will be laid. In order to obtain the proper exposure of the shingles in course 5, the butts of the shingles in the panels forming course 6 are butted against the upper edge of the strip 2 integrating the shingles in the panel of course 5. The panel in course 6 will be offset lengthwise relative to the panel in course 5 in the same direction as the panel in course 5 is offset relative to the panel in course 4. Thus, as shown, the right end of the panel in course 6 will be shifted to the left relative to the adjacent end of the panel in course 5 by the offset increment of 6*a*, which will be approximately 1 ½ inches (3.81 cm).

Because the length of the panels in course 6 is the same as the length of the panels in course 5, the left end of the left panel in course 6 will project beyond the left end of the left panel in course 5 by an increment 6*b* equal to the increment 6*a* at the right end of the course 6 panel. Such projection will represent a double width offset of the left end of the panel in course 6 from the roof rake and the left end of the left shingle panel in course 4, which would be approximately 3 inches (7.62 cm). Since again the pattern of the arrangement of shingle widths in the panel of course 6 is the same as the pattern for the shingle widths in the panel of course 5, the joints in the panel of course 6 will all be offset by an increment of approximately 1 ½ inches (3.81 cm) from the joints between the shingles in the panel of course 5, as indicated at 6*c*, 6*d*, 6*e*, 6*f*, 6*g* and 6*h*.

The same procedure is repeated in laying the next higher course 7. Again, the right end of the left panel in that course is offset from the adjacent end of the corresponding panel in course 6 by an offset 7*a* of approximately 1 ½ inches (3.81 cm) which effects a projection 7*b* of the left end of such panel beyond the adjacent left end of the corresponding panel in course 6 of the same amount. The overhang of the left end of the panel in course 7 beyond the roof rake and the left end of the left shingle panel in course 4 will be three offset increments or approximately 4 ½ inches (11.43 cm).

Successive courses can be laid above course 7, in each instance the right end of the panel being shifted to the left by the same increment from the adjacent end of the corresponding panel in the next lower course. Correspondingly, the overhang projection of the left end of each panel in successively higher courses will increase progressively by the same increment. When the laying of the roof has been completed, or at any convenient time, the left end portions of the panels overhanging the rake can be cut off appropriately and a facing board applied. Such removed left end portions of the panels could be used to fill in spaces at the right ends of the courses as appropriate.

Alternatively, the incremental longitudinal shifting of panels in successively higher courses could be to the right instead of to the left so that there would be a progressively increasing space between the left end of the panels and the roof rake or end for progressively higher courses. Upon completion of the roof, such spaces could be filled in by corresponding right end portions of other panels cut from the right end of the roof.

As each panel is laid, the tip portions of the shingles in the panel are nailed or staple to solid or strip sheathing beneath the panels in accordance with the customary practice of nailing individually applied shingles about 1 inch (2.54 cm) above the butt portion of the shingles to be exposed to the weather. As mentioned above, each integrating strip 2 is secured to the shingles by unclinched staples 3. Since these staples are not clinched, the integrating strips can be pulled off each panel after the shingles in the next higher course panel have been laid by being secured to the sheathing.

The completed roof or sidewall will have both the appearance and structure of having been fabricated from individually laid shingles. The work involved in laying the shingles is, however, much less than in laying shingles individually because (1) it is not necessary to select shingles of a particular width or to trim shingles in order to break joints, (2) multiple shingles instead of individual shingles can be handled, namely, in the type of panel illustrated seven shingles at a time instead of one, (3) it is not necessary to select the individual spacing at the joints between the shingles but only the spacing between the shingle panels and (4) finally the butts of the shingles in each shingle panel are engaged with an integrating strip of the panel below constituting a gauge strip establishing the proper exposure to the weather without measuring and marking or stripping the weather exposure on the job.

In order to obtain these advantages, it is only necessary that the minimum width of shingle in each panel, such as 5 inches (12.70 cm), be at least three times the maximum offset of the panels in each course, such as 1 ½ inches (3.81 cm), and that the pattern of arrangement of shingle widths in all of the panels be the same. These factors also apply to the arrangement of shakes 8 in the panel shown in FIG. 4. The only difference in the shake panel over the shingle panel is that the integrating strip 9 could be a little heavier because of the greater weight of the shakes and that the edge of the strip 9 farther from the butts of the shakes be spaced from such butts by the appropriate weather exposure width, such as 10 inches (25.40 cm) for shakes 24 inches (60.96 cm) long.

Figure 6:
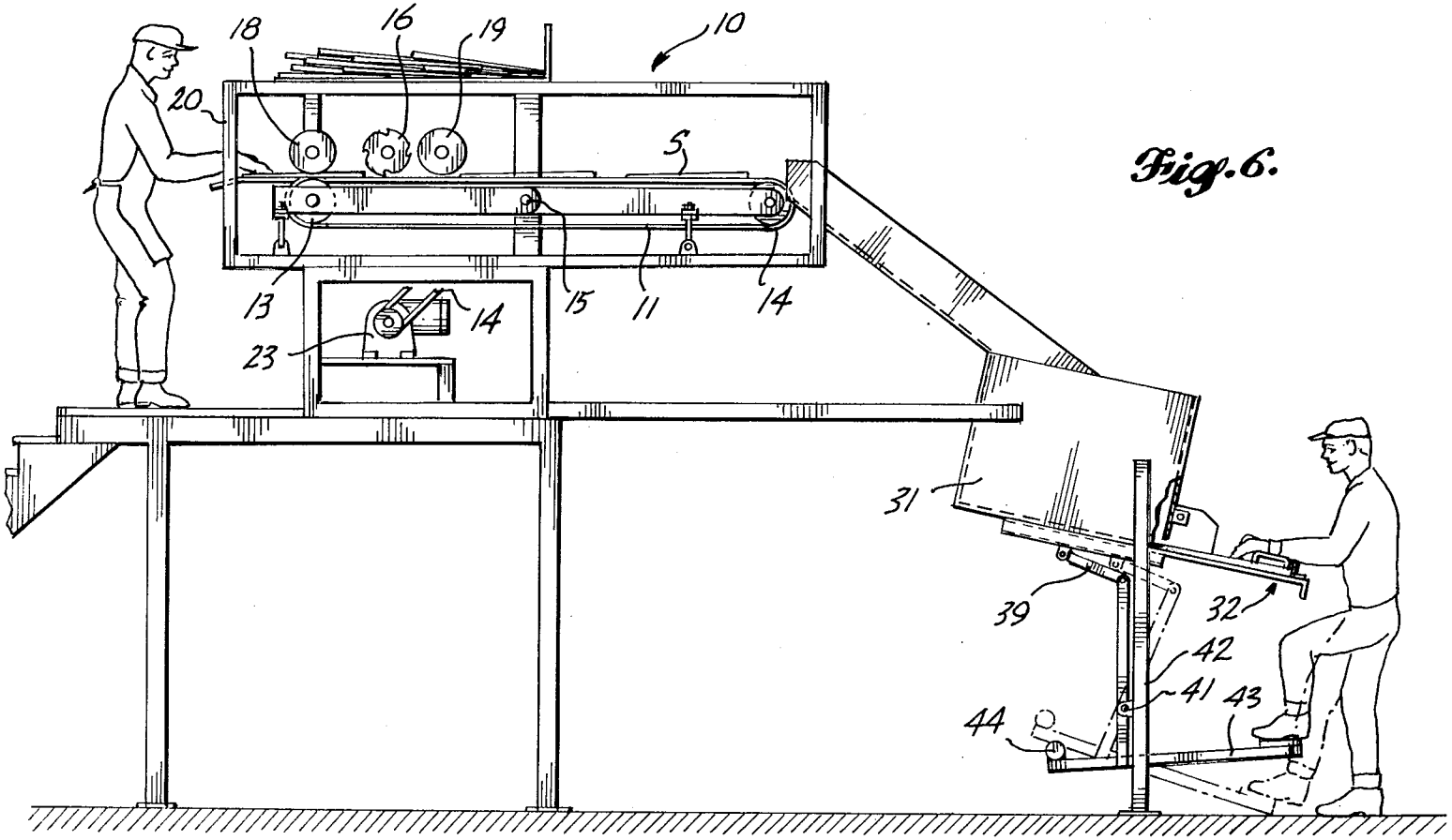
FIG. 6 is a somewhat diagrammatic side elevation of apparatus for making shingle or shake panels according to the present invention.
Figure 7:
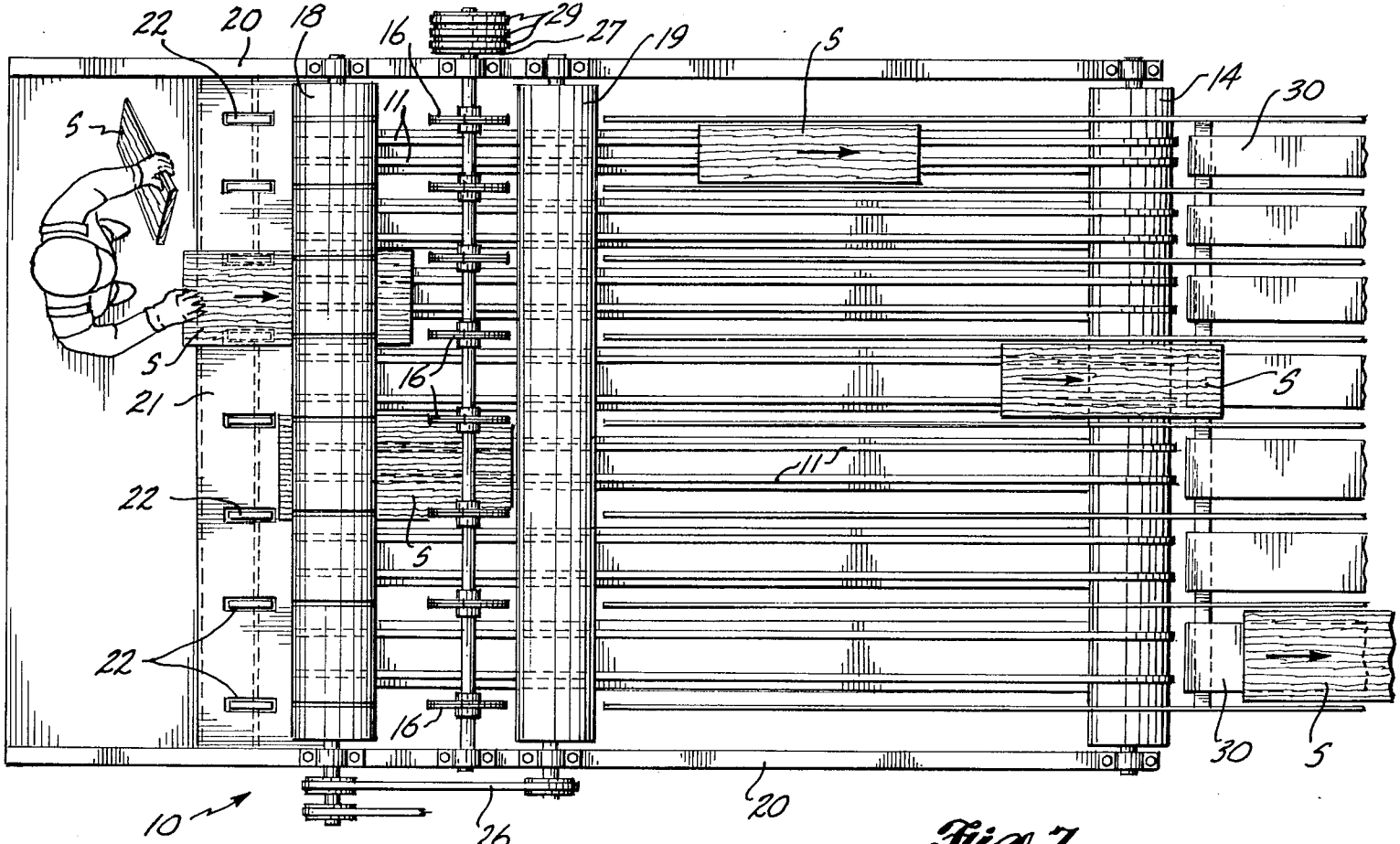
FIG. 7 is a plan of the infeed portion of the apparatus shown in FIG. 6.

Apparatus for making shake or shingle panels according to the present invention is shown in FIGS. 6 to 13, inclusive. Such apparatus includes an infeed edging and width-trimming section 10 having pairs of V-belts 11 for transporting individual shingles lengthwise. As shown in FIG. 7, such pairs of belts are spaced transversely different distances corresponding to the width of the shingles S. The spacing between the pairs of V-belts is shown as increasing from the upper portion of FIG. 7 to the lower portion by increments corresponding to the incremental increase in the width of the shingles in the panels to be fabricated from such shingles. Such V-belts extend between pulleys 13 at the feed end and pulleys 14 at the discharge end of such infeed section. A tightener or spreader 15 can be provided between the pulleys 13 and 14 to hold the V-belts sufficiently tight.

The V-belts 11 carry the individual shingles or shakes S between circular trim and edging saws 16 mounted in appropriately spaced relationship on a shaft 17. The shingles are fed butt first beneath hold-down rollers 18 overlying the pulleys 13. The shingles are trimmed to appropriate width by the saws 16 with minimum waste. During trimming, the outfeed portions of the shingles are held down by rollers 19 overlying the belts 11.

The rollers 13 and 14 and the hold-down rollers 18 and 19, as well as the shaft 17 carrying saws 16, are all supported by a frame 20. Such frame also supports a feed table 21 at the feed end of the apparatus on which a workman places shingles in appropriate positions. Spaced along such feed table are spring-held, retractable dividers or gauge bars 22 spaced apart appropriately to gauge the opposite edges of shingles to be trimmed. Such dividers or gauge bars are located in alignment or registration with the saws 16, respectively. The spacing of such dividers or gauge bars will indicate to the workman placing shingles on the feed table 21 the appropriate locations for shingles of different widths. When a shingle is placed on the feed table it will depress one or both gauge bars adjacent to its opposite edges to indicate the proper position of the shingle to be trimmed and edged by the saws 16.

Figure 8:
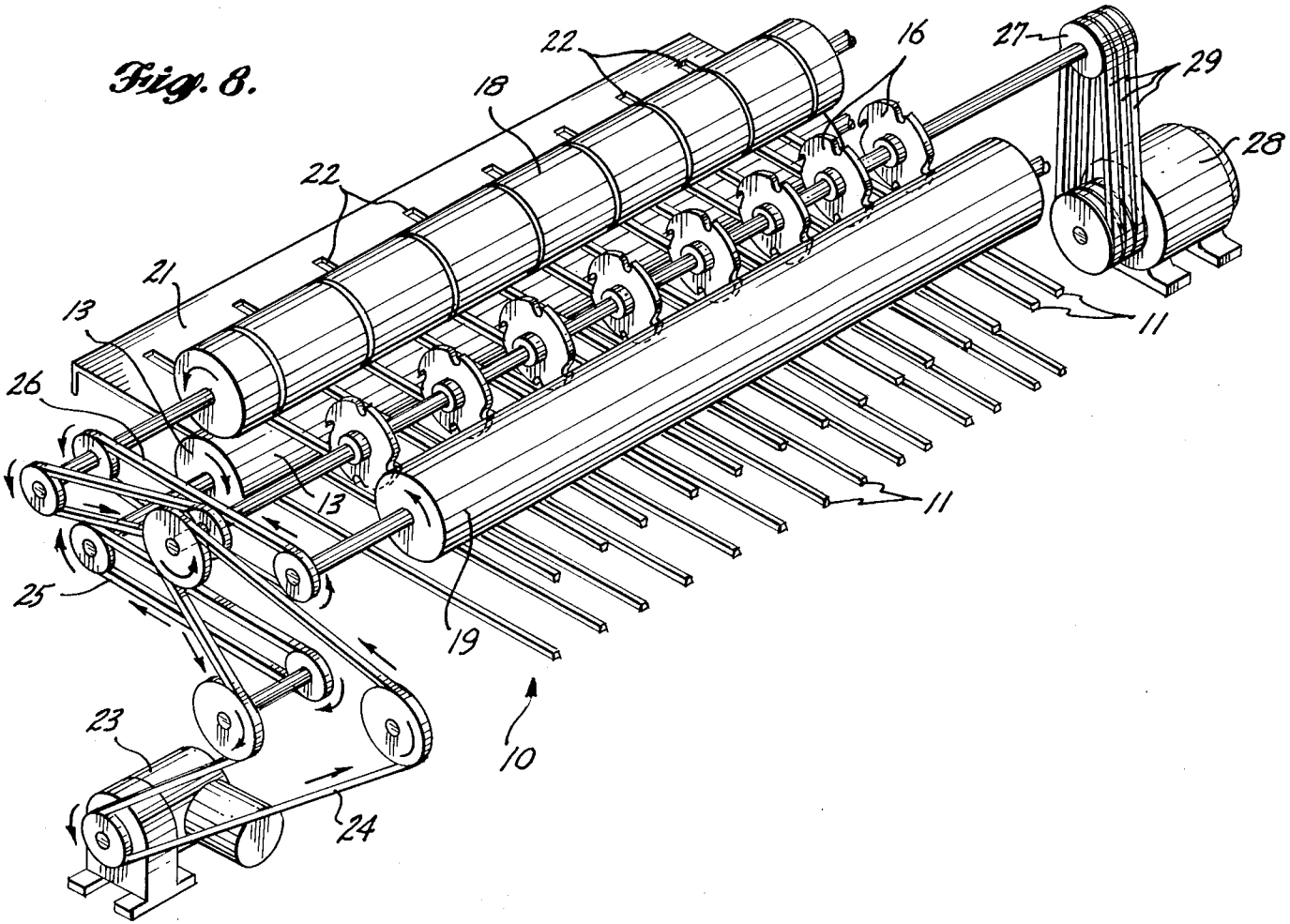
FIG. 8 is a top perspective of a portion of the apparatus shown in FIG. 7.
Figure 9:
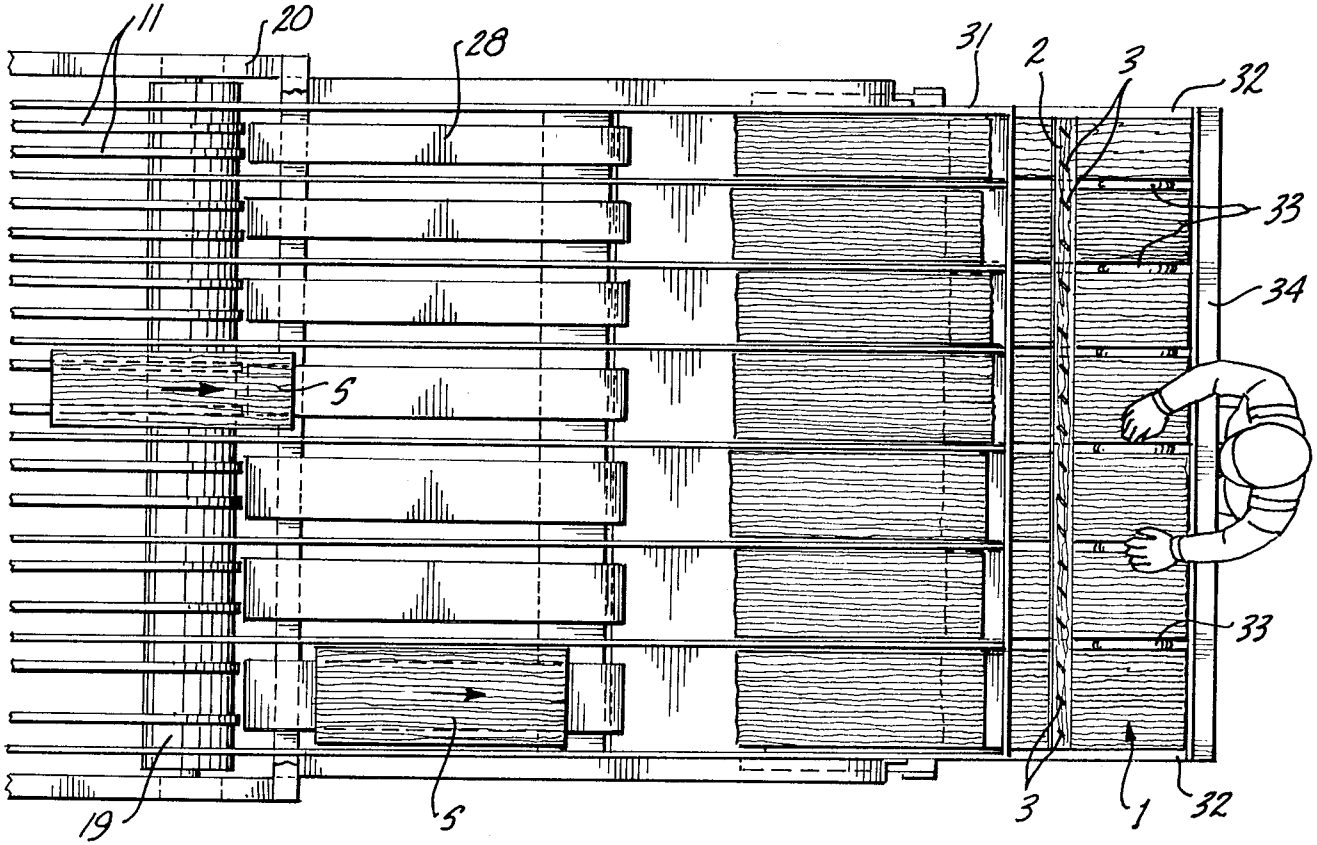
FIG. 9 is a plan of the outfeed portion of the apparatus shown in FIG. 6.

The pulleys 13 and 14 carrying belts 11 and the hold-down rollers 18 and 19 are powered by a motor 23 which drives belt 24 that in turn drives belt 25 effecting and coordinating rotation of the pulleys 13 and 14 and belt 26 effecting and coordinating rotation of the hold-down rollers 18 and 19 so that the pulleys 13 and 14 will rotate in the direction opposite such hold-down rollers. Shaft 17 carrying saws 16 is driven by a pulley 27 powered by a separate motor 28 through belts 29, as shown in FIG. 8.

The trimmed shingles are deposited by the belts 11 into a discharge chute 30 constituting transfer means which feeds the shingles endwise into a receiving bin 31. Since the shingles pass through the trimming portion of the apparatus butt first, they are deposited in stacks in the bin 31 with their butts toward an assembly table 32 arranged at one side of the bin. Spacer rods or fins 33 projecting upward from such assembly table are spaced apart distances equal to the width of the shingles in a set of shingles for fabricating a panel. A stop flange 34 is engaged by the butts of shingles in the set so that they will be arranged in a row in proper lengthwise relationship.

Figure 10:
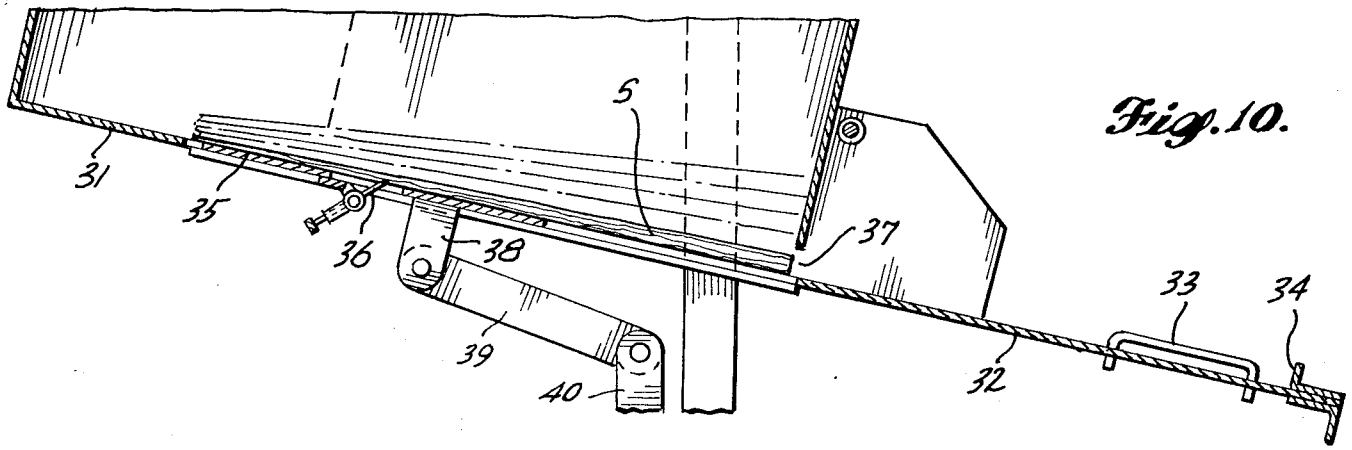
FIG. 10 is a fragmentary vertical section through a portion of the outfeed apparatus shown in FIG. 9.
Figure 11:
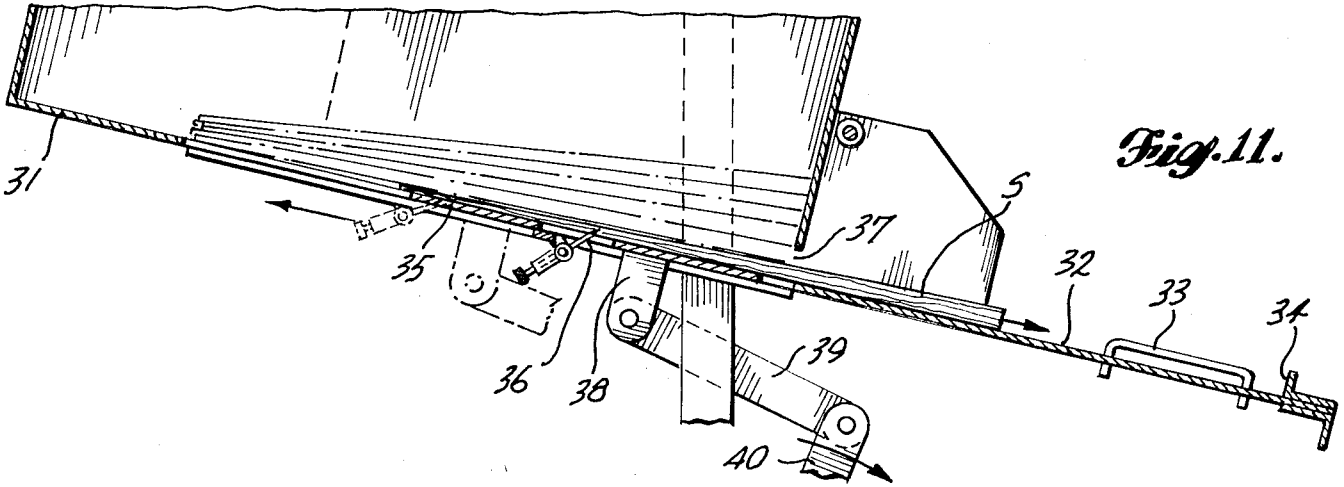
FIG. 11 is a similar view showing parts in different positions.

As shown in FIGS. 10 and 11, shingle-dispensing means includes a slide 35 carrying shingle-engaging points 36 mounted for reciprocation in the bottom of the bin 31 to slide single sets of shingles endwise from the bottoms of the shingle stacks in the bin through a slot 37 in the bottom of the bin wall next to the assembly table 32. Reciprocation of such slide is effected by a lug 38 projecting downwardly from it. A link 39 connects such lug to a lever 40 swingably supported by a pivot 41 mounted on a post 42 that supports the bin. A treadle bar 43 is rigidly secured to the lower end of the lever 40, one end of which may be engaged by the foot of the workman. A counterweight 44 is mounted on the other end of the treadle to swing it normally into a position in which the foot-engageable end is raised.

The slide 35 can be reciprocated to feed a set of shingles onto the assembly table 32 by the workman pressing the treadle from the solid line position shown in FIG. 6 to the broken line position. Such treadle actuation shifts the slide from the position shown in FIG. 10 to the position shown in FIG. 11 so that the points 36 will eject a set of shingles from the bottoms of the stacks of shingles in bin 31 through the slot 37 for access by the workman. When the butt ends of such set of shingles is in contact with flange 34, the workman staples an integrating strip 3 onto the shingle assembly to fabricate the panel.

Figure 12:
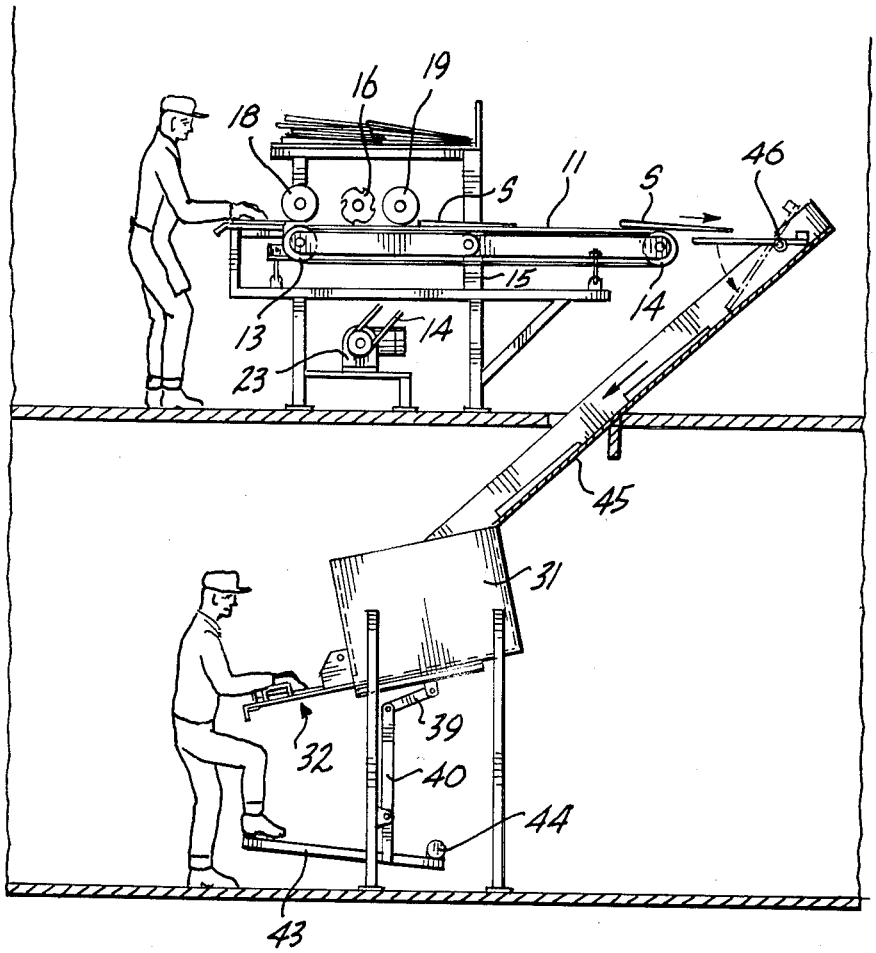
FIG. 12 is a somewhat diagrammatic elevation of apparatus for making shingle or shake panels according to the present invention modified from the apparatus shown in FIG. 6.

Instead of the shingles being transported always in the same direction from the feed end of the apparatus to the assembly table, the shingles can be discharged from the trimming section 10 into an assembly section by reversing the shingles end-for-end as shown in the apparatus of FIG. 12. The trimming section of the apparatus is the same as described in connection with FIGS. 6, 7 and 8, inclusive, except that the shingles are fed into the trimming section tip first instead of butt first.

The tips of shingles discharged from the trimming section of the apparatus to the chute 45 of the transfer means pass over a rod 46 to engage the bottom of the chute whereupon the heavier butt portions of the shingles will swing downward around the rod 46 so that the shingles will slide butt first down the chute 45 into the bin 31. The orientation of the shingles in such bin is the same as described in connection with FIGS. 6, 10 and 11 and the operation of dispensing shingles from the bin to the assembly table is the same. The advantage of this apparatus is that the shingles can move more smoothly through the trimming section of the apparatus if they are traveling tip first under the hold-down rollers 18 and 19 rather than butt first. In such case it is not necessary for the shingle butts to bump the hold-down rollers 18 up abruptly so that the shingles can pass beneath them, but the tip portions of the shingles engaging the hold-down rollers before the butt portions will lift the hold-down rollers gradually.

FIG. 7 shows the workman feeding shingles one at a time to the table 21. Such shingles will be moved in random arrangement through the trimming section of the bin of the machine as shown in FIG. 7. Consequently, shingles of different widths will accumulate at different rates in the several stacks in the bin 31. An alternative procedure would be for the workman to arrange a complete set of shingles on the feed table 21 before such set was moved through the trimming section of the machine. By using the latter type of operation, the shingles would accumulate in the bin 31 in sets so that the several stacks of shingles in the bin would always be of the same height.

It may be desirable for the panel-fabricating apparatus to be operated intermittently by the feed workman arranging a complete set of shingles on the feed table 21 while the apparatus is stopped. Next the apparatus can be started to move such set of shingles through the trimming apparatus until they have cleared the feed table 21. The apparatus can then be stopped while the feed workman assembles on the feed table another set of shingles, whereupon the apparatus can be started again and its drive continued until that set of shingles has cleared the apron. Such operation of the apparatus will insure that, instead of the shingles being in unrelated positions as shown in FIG. 7, a complete set of shingles will move through the trimming section of the apparatus down the discharge chute and into the bin 31 as a unit.

Figure 13:
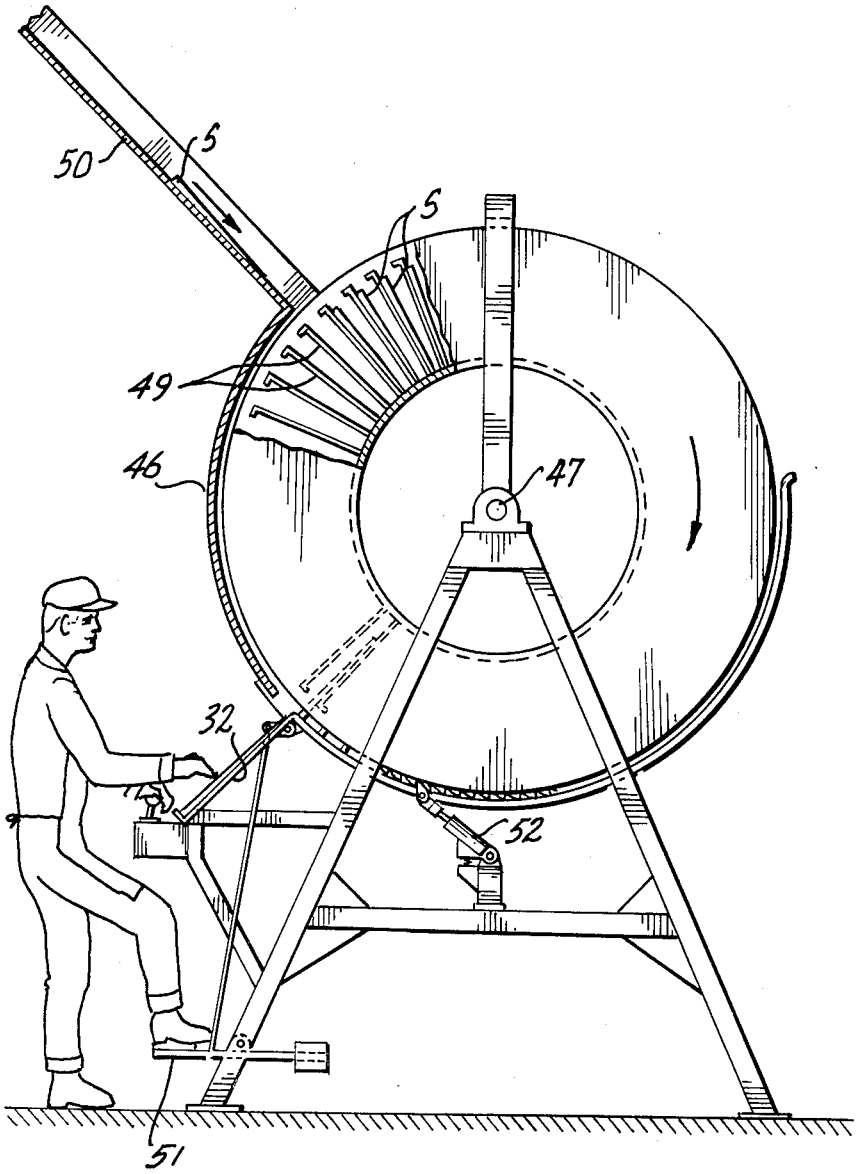
FIG. 13 is a somewhat diagrammatic elevation of a further modified discharge end portion of apparatus for making shingle or shake panels according to the present invention with parts broken away.

In FIG. 13, an alternative type of storage arrangement for sets of shingles to be assembled is shown. In this instance, the bin 31 is replaced by a wheel 46 rotatably mounted on a shaft 47 carried by a suitable frame 48. Radial partitions 49 are arranged around the periphery of the wheel to provide outwardly opening slots for receiving sets of shingles to be assembled from the chute 50 to which the shingles are discharged from the trimming section of the apparatus. Depression of a treadle 51 by the workman's foot will actuate a fluid pressure jack 52 that indexes rotation of the wheel 46 incrementally through a distance equal to the circumferential spacing of the partitions 49. As the wheel is indexed through each such increment, a set of shingles to be assembled will be discharged from the peripheral slot between adjacent partitions onto the assembly table 32. The shingles in such set may then be fabricated by the workman into a shingle panel by affixing a cleat to the shingles in the manner described in connection with FIGS. 6, 10 and 11.

Radial partitions 49 can be spaced apart a distance to receive between them only a single shingle or they can be spaced farther apart to receive several shingles in a stack. Also, instead of a single wheel being provided with radial partitions to receive sets of shingles such that each set will make a complete panel, the wheel 46 can be sectioned so that each section is of a width to receive only single shingles of a particular width. In such case the wheel sections will be mounted to rotate independently of each other and to dispense shingles independently to the workmen for assembly into panels.

I claim:

1. A group of shingle or shake panel articles of commerce, each panel article comprising only one row of shingles or shakes which are not all of equal width and which are tapered in thickness from butt to tip and arranged with their butt ends generally in alignment and with the shingles or shakes in all the panels in the same pattern as to width from one end of the panel to the other, and an integrating strip removably secured lengthwise of said row to the outer face of the butt portion of each of said shingles or shakes in each panel holding said shingles or shakes together in such row with the edge of said integrating strip farther from the shingle or shaker butt ends spaced from the shingle or shake butt ends a distance equal to the desired width of exposure of the butt portions of said shingles or shakes to the weather when they have been laid so that said integrating strip is exposed after said shingles or shakes have been laid and can be removed from the outer faces of said shingles or shakes after said shingles or shakes have been laid.

2. The group of panel articles of commerce defined in claim 1, in which the integrating strip is secured to the shingles or shakes of each panel by unclinched staples to facilitate the removal of the integrating strip from the shingles or shakes of each such panel after the shingles or shakes of such panel have been laid.

3. The group of panel articles of commerce defined in claim 1, in which the corresponding ends of panels in adjacent courses are to be offset lengthwise of the courses and the width of the narrowest shingle or shake in each panel is at least substantially as great as three times the distance which panels in adjacent courses are to be offset lengthwise.

4. A shingle or shake panel article of commerce comprising only one row of shingles or shakes tapered in thickness from butt to tip and arranged with their butt ends generally in alignment, which shingles or shakes are not all of equal width and are arranged in said row with the widths of successive shingles or shakes increasing from one end of the panel to the other, and an integrating strip removably secured lengthwise of said row to the outer face of the butt portion of each of said shingles or shakes in the panel holding said shingles or shakes together in such row with the edge of said integrating strip farther from the shingle or shake butt ends spaced from the shingle or shake butt ends a distance equal to the desired width of exposure of the butt portions of said shingles or shakes to the weather when they have been laid so that said integrating strip is exposed after said shingles or shakes have been laid and can be removed from the outer faces of said shingles or shakes after said shingles or shakes have been laid.

5. The panel article defined in claim 4, the widths of successive shingles or shakes increasing progressively from one end of the panel to the other by substantially equal increments.

6. A shingle or shake roof or wall structure including upper and lower shingle or shake panels in adjacent courses, each of said panels having only one row of shingles or shakes tapered in thickness from butt to tip and arranged with the butts of the shingles or shakes in such row generally in alignment, the shingles or shakes in both panels having the same pattern as to width from one end of each panel to the other, an integrating strip extending lengthwise of said lower panel and removably secured to the outer face of the butt portion of each of said shingles or shakes in said lower panel holding said shingles or shakes together in said lower panel with the edge of said integrating strip farther from the butt ends of said shingle or shakes in said lower panel spaced from the butt ends of said shingles or shakes in said lower panel a distance equal to the desired width of exposure to the weather of the butt portions of said shingles or shakes in said lower panel, and the butt ends of said shingles or shakes in said upper panel being disposed substantially in abutment with the upper edge of said integrating strip of said lower panel so as to locate the shingles or shakes of said upper panel in predetermined elevational relationship to the shingles or shakes of said lower panel and leave said integrating strip of said lower panel exposed for removal after said upper and lower panels have been laid and said upper and lower panels being relatively offset lengthwise to offset elevationally the joints between the shingles or shakes of said upper and lower panels.

7. A shingle or shake roof or wall structure including at least three courses formed of shingle or shake panels, each of said panels in said courses being composed of only one row of shingles or shakes, which shingles or shakes in each such row are not all of equal width, but the shingles or shakes in the respective corresponding positions of said panels in said courses are of the same width, and an upper panel in the course next above a given panel is offset from said given panel lengthwise of said given panel substantially the same distance and in the direction opposite the offset from said given panel of the lower panel in the course next below said given panel, and each of said offsets of said upper panel and said lower panel from said given panel lengthwise of said given panel does not substantially exceed one-third of the width of the narrowest shingle or shake in said panels.

8. The shingle or shake structure defined in claim 7, in which the shingles or shakes in each panel row are arranged with the widths of successive shingles or shakes increasing progressively from one end of the panel row to the other.

9. The shingle or shake structure defined in claim 8, in which the widths of the successive shingles or shakes increases progressively from one end of the panel row to the other by substantially equal increments.

* * * * *

UNITED STATES PATENT AND TRADEMARK OFFICE

CERTIFICATE OF CORRECTION

PATENT NO. : 4,782,639

DATED : November 8, 1988

INVENTOR(S) : Stewart Ferguson

It is certified that error appears in the above-identified patent and that said Letters Patent are hereby corrected as shown below:

ON THE TITLE PAGE:

Section [21] : amend the serial number to ...840,281...

Claim 1: column 9, line 61, change "shaker" to ...shake...

Signed and Sealed this

Fourth Day of April, 1989

*Attest:*

*Attesting Officer*

DONALD J. QUIGG

*Commissioner of Patents and Trademarks*